US007880396B2

(12) United States Patent
Pruett

(10) Patent No.: US 7,880,396 B2
(45) Date of Patent: Feb. 1, 2011

(54) PROJECTOR DEVICE EMPLOYING BALLAST WITH FLYBACK CONVERTER

(75) Inventor: Henry F. Pruett, North Bend, OR (US)

(73) Assignee: Seiko Epson Corporation, Shinjuku-ku, Tokyo (JP)

( * ) Notice: Subject to any disclaimer, the term of this patent is extended or adjusted under 35 U.S.C. 154(b) by 262 days.

(21) Appl. No.: 12/139,453

(22) Filed: Jun. 14, 2008

(65) Prior Publication Data

US 2008/0309246 A1 Dec. 18, 2008

Related U.S. Application Data

(60) Provisional application No. 60/934,881, filed on Jun. 14, 2007.

(51) Int. Cl.
*H05B 37/02* (2006.01)

(52) U.S. Cl. ..... 315/209 CD; 315/247; 315/276; 315/224; 315/291

(58) Field of Classification Search ..... 315/247, 315/246, 224, 225, 209, 291, 297, 307–311, 315/209 CD, 274–279
See application file for complete search history.

(56) References Cited

U.S. PATENT DOCUMENTS

| | | | |
|---|---|---|---|
| 3,689,760 | A | 9/1972 | Stewart |
| 4,321,504 | A | 3/1982 | Keeffe et al. |
| 4,516,856 | A | 5/1985 | Popelka |
| 4,634,927 | A | 1/1987 | Mori et al. |
| 4,709,184 | A | 11/1987 | Keeffe et al. |
| 4,904,907 | A | 2/1990 | Allison et al. |
| 5,019,959 | A | 5/1991 | MacDonald et al. |
| 5,144,201 | A | 9/1992 | Graham et al. |

(Continued)

FOREIGN PATENT DOCUMENTS

| | | |
|---|---|---|
| EP | 0443964 | 8/1991 |

(Continued)

OTHER PUBLICATIONS

"Low-Power Single Operational Amplifier." http://focus.ti.com/lit/ds/slos489a/slos489a.pdf. SLOS489A; Dec. 2005; revised Mar. 2007. Texas Instruments Incorporated. Dallas, TX.

(Continued)

*Primary Examiner*—Tuyet Thi Vo
(74) *Attorney, Agent, or Firm*—Townsend and Townsend and Crew, LLP

(57) ABSTRACT

A projector device employing ballast with a flyback converter is disclosed. For example, one embodiment comprises a lamp driver circuit including a power stage circuit including a flyback converter to output a direct current signal to a bridge circuit, the bridge circuit to reconstruct the direct current signal to an alternating current signal, a control circuit coupled with the power stage circuit and the bridge circuit, the control circuit to receive the direct current signal from the power stage circuit and to provide a frequency control signal to the bridge circuit, and a lamp igniter circuit comprising at least one charge pump and being coupled with the bridge circuit, wherein in response to the frequency control signal being provided to the bridge circuit, the bridge circuit is configured to increase the voltage of the alternating current signal provided to the lamp igniter circuit to power the lamp igniter circuit.

18 Claims, 7 Drawing Sheets

U.S. PATENT DOCUMENTS

| | | | | |
|---|---|---|---|---|
| 5,291,100 | A | 3/1994 | Wood | |
| 5,781,252 | A | 7/1998 | Gale | |
| 6,281,642 | B1 | 8/2001 | Konishi et al. | |
| 6,294,879 | B1 | 9/2001 | Nagase et al. | |
| 6,300,729 | B1 | 10/2001 | Keijser et al. | |
| 6,424,097 | B1 | 7/2002 | Pruett et al. | |
| 6,624,585 | B2 | 9/2003 | Pruett | |
| 6,853,152 | B2 | 2/2005 | Duffy et al. | |
| 7,012,381 | B2 | 3/2006 | Samejima et al. | |
| 7,075,806 | B2 | 7/2006 | Ichikawa et al. | |
| 7,077,530 | B2 | 7/2006 | Chen et al. | |
| 7,091,670 | B2 | 8/2006 | Pruett et al. | |
| 7,095,185 | B2 | 8/2006 | Nemirow et al. | |
| 7,161,307 | B2 | 1/2007 | Chen | |
| 7,176,638 | B2 | 2/2007 | Ito et al. | |
| 2003/0057849 | A1 | 3/2003 | Pruett et al. | |
| 2003/0214254 | A1 | 11/2003 | Shloush et al. | |
| 2006/0028148 | A1 | 2/2006 | Ichikawa et al. | |
| 2006/0158411 | A1 | 7/2006 | Sakashita | |
| 2006/0197470 | A1* | 9/2006 | Ribarich et al. | 315/291 |
| 2006/0279229 | A1 | 12/2006 | Okawa | |
| 2007/0024204 | A1 | 2/2007 | Fujii et al. | |
| 2007/0052373 | A1 | 3/2007 | Hui et al. | |
| 2007/0057642 | A1 | 3/2007 | Pruett | |
| 2007/0138972 | A1 | 6/2007 | Siessegger | |
| 2007/0138975 | A1 | 6/2007 | Suganuma et al. | |
| 2007/0146958 | A1 | 6/2007 | Babcock et al. | |
| 2008/0239761 | A1* | 10/2008 | Jacques et al. | 363/21.02 |

FOREIGN PATENT DOCUMENTS

| | | |
|---|---|---|
| GB | 2090971 | 7/1982 |
| WO | 9212611 | 7/1992 |

OTHER PUBLICATIONS

"IRF7453." http://www.irf.com/product-info/datasheets/data/irf7453.pdf. Feb. 1, 2001. International Rectifier. El Segundo, CA.

"IRFS4227PbF, IRFSL4227PbF." http://www.irf.com/product-info/datasheets/data/irfs4227pbf.pdf. Sep. 14, 2007. International Rectifier. El Segundo, CA.

* cited by examiner

PROJECTOR DEVICE EMPLOYING BALLAST WITH FLYBACK CONVERTER

CROSS-REFERENCE TO RELATED APPLICATIONS

This application claims priority from U.S. Provisional Patent Application Ser. No. 60/934,881 of Henry Pruett, entitled "PROJECTOR DEVICE EMPLOYING BALLAST WITH FLYBACK CONVERTER", filed Jun. 14, 2007, the disclosure of which is hereby incorporated by reference in its entirety and for all purposes.

FIELD

The present application relates to systems, apparatus and methods for regulating power in a projector using a ballast and a flyback converter.

BACKGROUND

Display technologies continue to advance and display devices continue to improve in image quality and resolution. Projection display devices include an optical subsystem for displaying images (e.g., still images or video). Such optical subsystems typically include an illumination source (e.g., a high pressure mercury lamp) for generating light to project such images. The illumination source (lamp) is powered (driven) by a lamp driver circuit. Current lamp driver circuits have certain drawbacks, however.

Current lamp driver circuits include a design tradeoff as most display device lamp bulbs are short arc lamps. To increase the useful life of these lamps, small output capacitors are used in lamp driver circuits to drive lamps in order to reduce transient current that is delivered to a lamp from a driver circuit. However, this may require the use of filtering to reduce ripple currents and thus reduce arc jumping and flicker within the lamp. The use of such filtering conflicts with the goal of reducing the size of the lamp driver circuit's output capacitors. Therefore, there is a trade off between reducing ripple current and reducing the size of the lamp driver circuit output capacitors.

Another drawback of current lamp driver circuits is the overall cost of such circuits. Current approaches for implementing lamp driver circuits utilize two active converters, a front end converter, which may be termed a power factor converter, and a back end converter, which converts the power provided by the front end converter to provide direct current (DC) power that is usable for driving a projector lamp.

And yet another drawback of current lamp driver circuits is they typically use an alternating current power supply. A drawback of using an alternating current power supply is a lack of sufficient isolation in the electronic components of a projector and lamp drive circuitry. This can increase the risk of electrocution if a projector is operational or even if it is shut off. Further, in order to provide sufficient isolation may reduce portability for small form factor projectors, may increase cost, and increase component density within a projector, as non-limiting examples.

Some projection systems may use a relatively low-power lamp, allowing a projection system to use a DC power source, which in turn greatly expands the applications for which the projection system can be used while decreasing some safety risks associated with AC powered projectors. However, the DC power source presents challenges in providing a consistent and constant power source, which can steadily power the lamp and produce illumination with a small amount of brightness variation.

The foregoing examples of the related art and limitations related therewith are intended to be illustrative and not exclusive. Other limitations of the related art will become apparent to those of skill in the art upon a reading of the specification and a study of the drawings.

SUMMARY

Accordingly, various embodiments for projection using ballast with a flyback converter are described below in the Detailed Description. For example, one embodiment comprises a lamp driver circuit including a power stage circuit including a flyback converter to output a direct current signal to a bridge circuit, the bridge circuit to reconstruct the direct current signal to an alternating current signal, a control circuit coupled with the power stage circuit and the bridge circuit, the control circuit to receive the direct current signal from the power stage circuit and to provide a frequency control signal to the bridge circuit, and a lamp igniter circuit comprising at least one charge pump and being coupled with the bridge circuit, wherein in response to the frequency control signal being provided to the bridge circuit, the bridge circuit is configured to increase the voltage of the alternating current signal provided to the lamp igniter circuit to power the lamp igniter circuit.

This Summary is provided to introduce concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
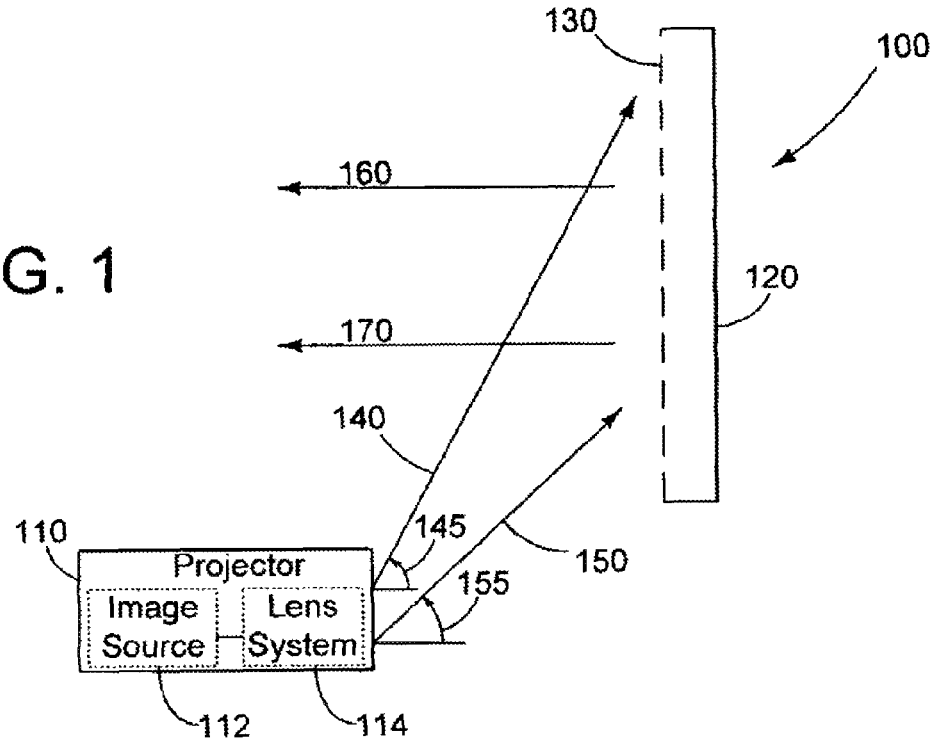
FIG. 1 shows an exemplary projection device.

Prior to describing a detailed embodiment of a projection device employing ballast with a flyback converter, one use environment including a front projection display system is described. In FIG. 1, a front projection display system 100 is illustrated and may include a display device, such as a projector 110, and a viewing surface, such as a screen 120 including a screen surface 130. In the illustrated environment, projector 110 may be configured to generate an image and to project the image on screen surface 130 such that screen 120 may reflect the projected image toward a viewer (not shown). Although shown and described in relation to a front projection device where the image displayed is on the same side as the projection device, it should be appreciated that projection systems according to the present disclosure can also be used in rear projection arrangements within the principles of this disclosure.

Projector 110 as illustrated includes an image source 112, which may include at least one image-generation device, including, but not limited to, a digital micromirror device (DMD), micro-electromechanical systems (MEMS), a grating light valve device (GLV), a liquid crystal display device (LCD), a liquid crystal on silicon devices (LCOS), etc. The image source may also include a lamp and/or other light source.

Projector 110 further may include a lens system 114 which may be integrated within projector 110 or otherwise coupled to projector 110 such that an image generated by the image source can be projected to screen 120 as indicated by arrows 140 and 150. The image may be reflected to a viewer as indicated by arrows 160, 170.

The lamp or other light source of image source 112 may be selected based on a number of different criteria. For example, one application may benefit from a light source capable of outputting a very bright light, while another application may benefit from a light source that is substantially smaller and/or cooler operating. In some embodiments, it may be beneficial to use a light source with a consistent output and/or one that produces little to no light artifacts.

The inventors herein have discovered that a projection device with a very small form factor may be desirable in many situations. The inventors have also discovered that the power requirements of the light source can drive the overall size of the projection device. However, some alternative, low-power light sources have been found to be unsatisfactory for many applications. High pressure metal halide lamps can provide brighter, more consistent, and/or higher-quality illumination for some applications.

It should be understood that a projection device in accordance with the present disclosure need not be battery operated. Other DC power sources can be used, including AC power sources that are transformed to DC by an external transformer (e.g., brick transformer) or a transformer integral with the projector. U.S. Pat. No. 7,077,530 provides one example of a projection device with an external power supply, an is incorporated by reference.

It should also be understood that lamps other than high pressure metal halide lamps can be used without departing from the scope of this disclosure. As a non-limiting example, other types of high intensity discharge lamps can be used.

Figure 2:
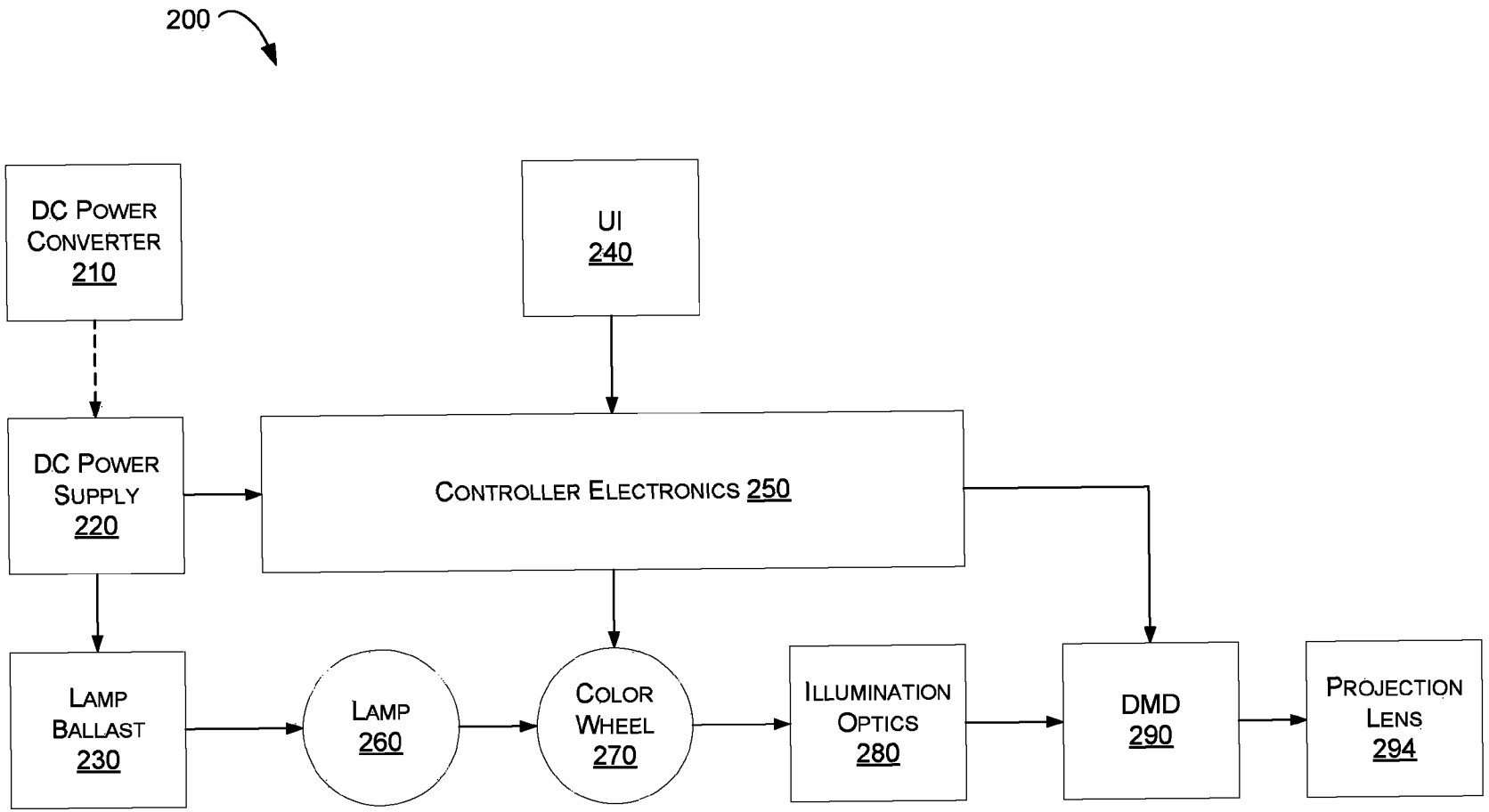
FIG. 2 shows another exemplary lamp driver circuitry including a ballast with a flyback converter.

FIG. 2 shows an exemplary projection device 200 in accordance with the present disclosure. Projection device 200 includes a lamp 260 such as a high pressure metal halide lamp, that is capable of producing a bright, consistent, and high-quality illumination. In an example embodiment, the lamp may use approximately 45-50 watts, which is significantly lower than traditional high pressure metal halide lamps used in projection systems. However, it should be understood that the power system of the present disclosure can be scaled up or scaled down to handle lamps with a wide range of power ratings.

In some embodiments, projection device 200 can be one pound or less, and can be operated off of one or more batteries. One or more DC to DC converters can be used to convert the voltage from a battery to the various voltages used by the projection device subsystems. In this way, a single battery and/or a single power system using plural batteries can be used to power the various components of the projection device, including the lamp 260.

In some embodiments, projection device 200 may include a ballast 230 that utilizes a flyback converter or a flyback transformer to provide substantially constant power delivery. Such a ballast 230 can convert a voltage from a DC power supply 220, for example a battery, to a higher voltage more appropriate for driving the lamp 260. Additionally, this approach allows a DC power source to be used to power a variety of different subsystems in a projection device 200, even if such subsystems use different voltages. In other embodiments, DC-to-DC converters other than flyback converters may be used, including but not limited to a buck converter, a boost converter, a buck-boost converter, a push-pull converter, etc. U.S. Pat. No. 7,095,185 provides one example of a fluorescent lamp that includes a flyback circuit, and is incorporated by reference.

Figure 3:
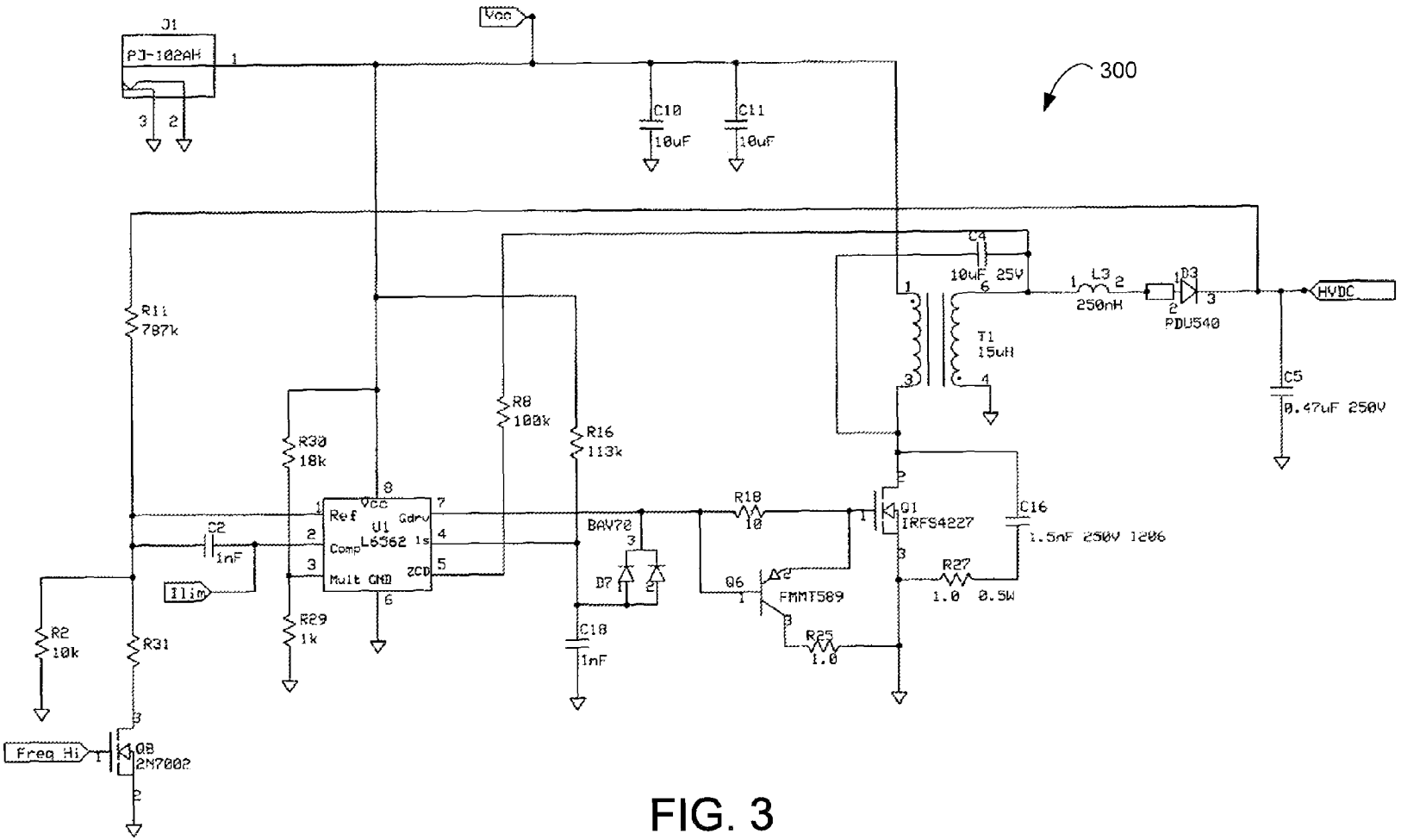
FIG. 3 shows a portion of an exemplary ballast circuit including a power stage for a 45 W lamp.
Figure 4:
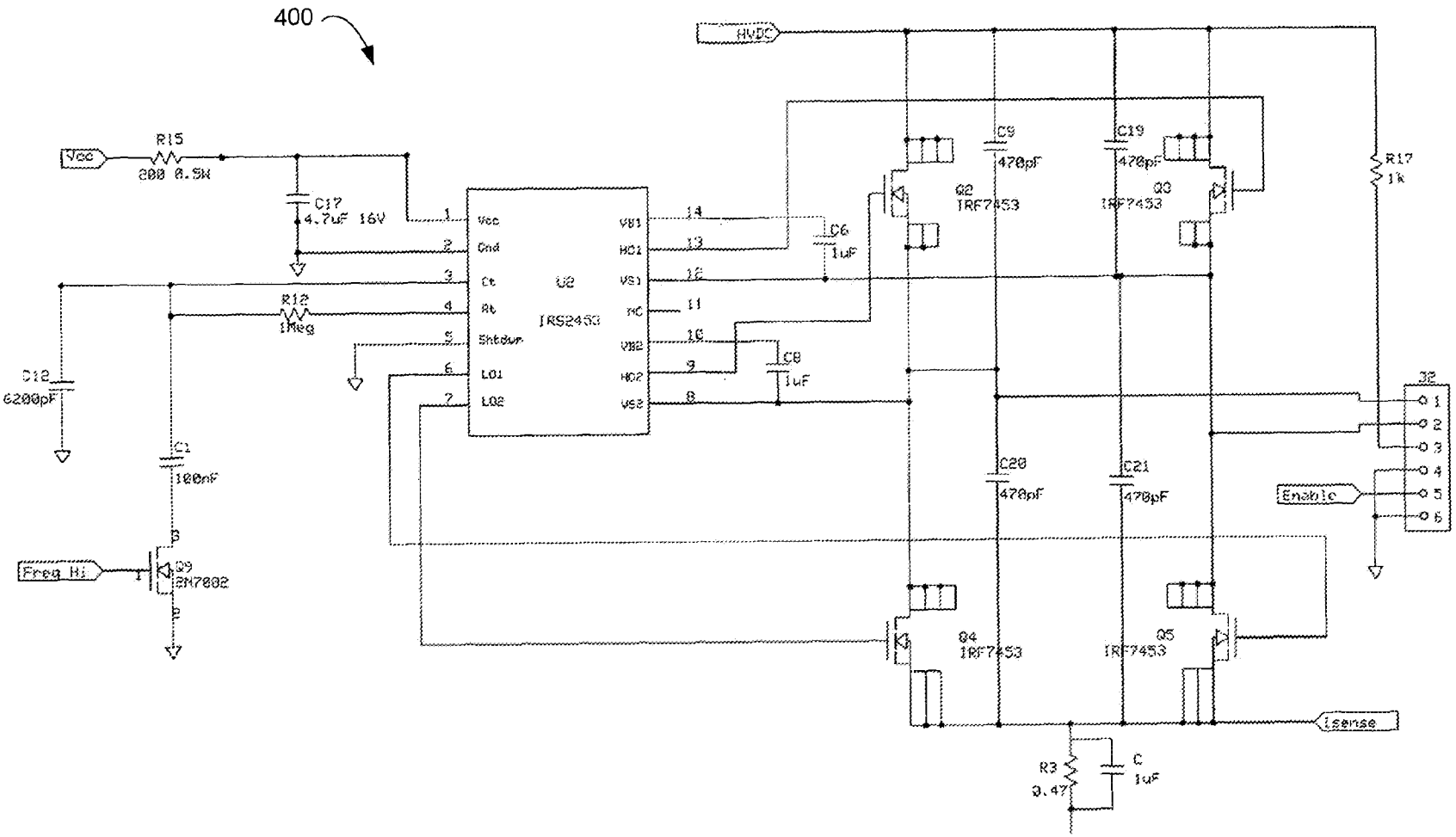
FIG. 4 shows a portion of an exemplary ballast circuit including a bridge circuit to generate an alternating current from a direct current.
Figure 5:
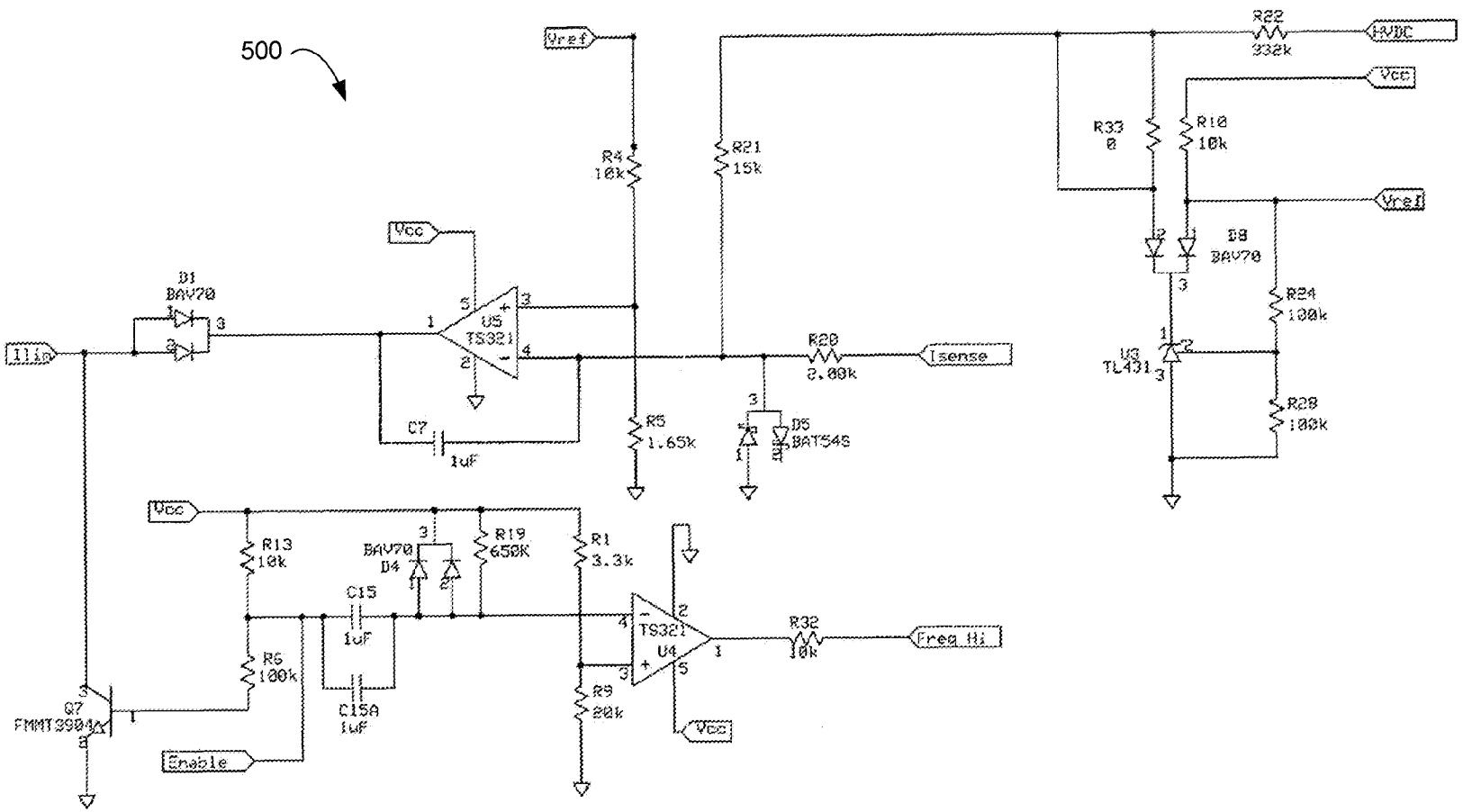
FIG. 5 shows an exemplary timing and power control circuit.
Figure 6:
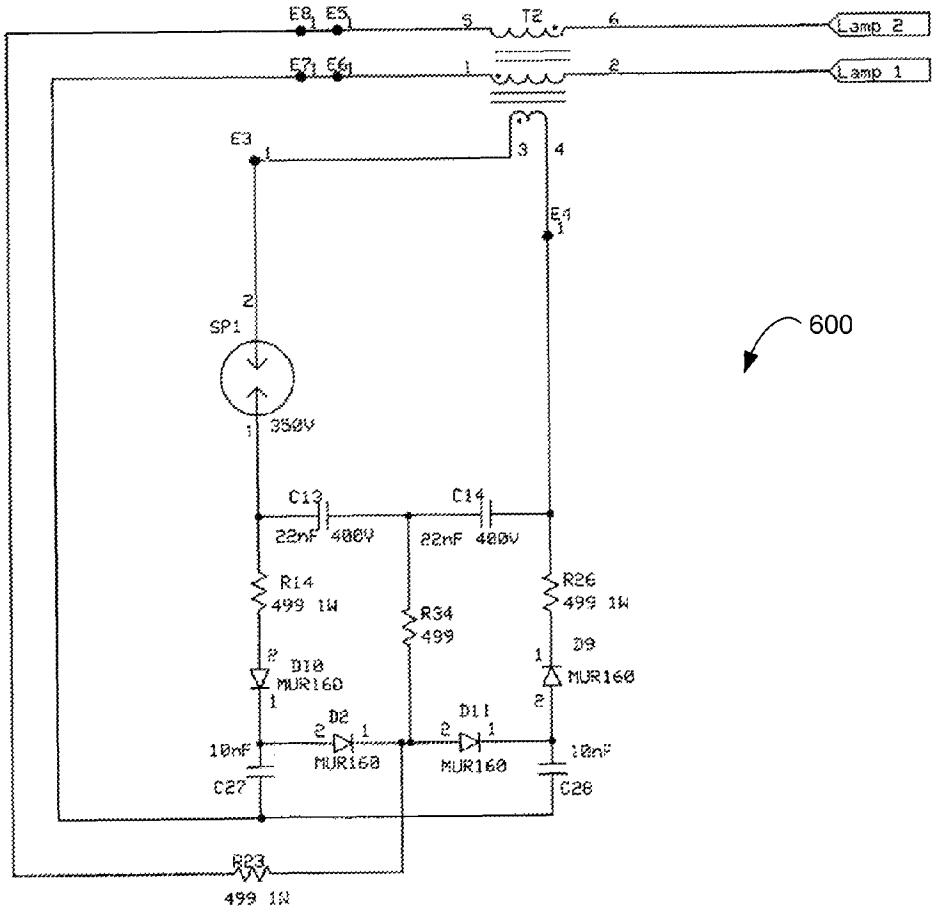
FIG. 6 shows a lamp igniter circuit that may be used in an embodiment.

FIGS. 3-6 illustrate some component circuits of an embodiment lamp ballast 230. FIG. 3 shows a power stage circuit 300, for example for a lamp ballast 230 for a 45 W lamp; FIG. 4 illustrates a bridge circuit 400 to generate an alternating current from a direct current. FIG. 5 illustrates a timing and power control circuit 500, and FIG. 6 illustrates a lamp igniter circuit 600 that may be used in some embodiments. The circuits illustrated in FIGS. 3-6 will be described in more detail in the following paragraphs.

FIG. 3 schematically illustrates a power stage circuit 300 that may be used in an exemplary lamp ballast 230 in accordance with the present disclosure. The power stage circuit 300 may be a stand-alone system, or may be used on the same circuit-board as one or more other components, such as bridge 400, control circuit 500, lamp igniter circuit 600, etc., all of which facilitate use of a DC power supply to drive the lamp at a consistent level. In some embodiments, two or more of the circuits depicted in FIGS. 3-6 may be part of the same printed circuit board, although this is not required.

Power stage circuit 300 includes in part a flyback converter T1 coupled with power supply Vcc and switching transistor Q1. In the illustrated embodiment, Vcc may be 19V. When Q1 is switched on, energy is added into T1 from low saturation transistor Q6, and when Q1 is turned off, stored charge is dumped by inductor L3 and diode D3. Some other embodiments may use a flyback converter T1 with other circuitry, yet still provide a DC signal from power stage circuit 300 according to the principles of this disclosure.

Flyback converter T1 also has a coupling capacitor C4 connecting windings of like phase, name pin 6 and pin 3 of the converter. Coupling capacitor C4 may be used to smooth a direct current signal HVDC output to bridge circuit 400 and control circuit 500. Power stage circuit 300 also includes a pulse width modulator (PWM) U1. In some embodiments PWM U1 may be a power factor correction (PFC) controller.

In some embodiments, PWM U1 may be used as a transition mode controller to start a new cycle when flyback converter has lost the majority of its energy. Power stage circuit 300 includes various other circuitry as will be explained below with reference to principles of operation involving components of multiple circuits. In the example bridge circuit 400 illustrated in FIG. 4, enable signal may receive an input from an external source, such as other components in a projector, and may start the timing circuitry in control circuit 500 and operating Q7 active on a low signal.

Bridge circuit 400 includes in part a timing controller U2 to control the configuration of the bridge component switches Q2, Q3, Q4, and Q5. Further, bridge circuit 400 includes capacitors C9, C19, C20, and C21 that bridge the two power terminals of each of the component switches Q2, Q3, Q4, and Q5, to wave shape an alternating current signal generated by bridge 400 and reduce electromagnetic interference (EMI) in the lamp driver circuit 200.

Referring now to FIG. 5, control circuit 500 includes in part a timing control circuit including amplifier U4, receiving power supply Vcc and an enable signal and generating a frequency control signal Freq Hi signal to output to power stage 300 at Q8 to increase output voltage, and also to be output to bridge circuit 400 to adjust the timing controller and the resulting alternating current signal generated by bridge circuit 400. In some embodiments, when Freq Hi is asserted the power stage circuit 300 may provide a startup phase HVDC signal of around 200V to 250V, although other embodiments are not so limited. Those skilled in the art would be able to utilize the teachings herein to adjust the HVDC signal to another voltage range, or even outside of a startup phase for some other suitable purpose.

Control circuit 500 also includes in part an error amplifier U5 that may be used during regular operation of lamp driver circuit 200 but may be disabled during a startup phase of lamp igniter circuit 600. Control circuit 500 may receive a sensing signal ISense and mix this signal with HVDC to control error amplifier U5 to regulate power in power stage circuit 300 by providing an analog limiting signal Ilim to capacitor C2 in power stage circuit 300. Now we describe one mode of operation for the circuitry in lamp ballast 230.

In one embodiment, a lamp driver circuit may include a power stage circuit 300 including a flyback converter T1 to output a direct current signal HVDC to a bridge circuit 400. In this way, the bridge circuit 400 may reconstruct the direct current signal HVDC to an alternating current signal. In some embodiments, a control circuit 500 may be coupled with the power stage circuit 300 and the bridge circuit 400, wherein the control circuit 500 may receive the direct current signal from the power stage circuit 300.

In this way, if a control circuit receives the direct current signal, it may generate and provide a frequency control signal Freq Hi to the bridge circuit 400. A lamp igniter circuit 600 comprising at least one charge pump may then be coupled with the bridge circuit 400, wherein in response to the frequency control signal Freq Hi being provided to the bridge circuit 400, the bridge circuit is configured to increase the voltage of the alternating current signal provided to the lamp igniter circuit 600 and power the lamp igniter circuit. In the embodiment lamp igniter circuit 600 illustrated in FIG. 6, two charge pumps are illustrated, with one charging and discharging capacitor C13 and the other charging and discharging capacitor C14. In some embodiments with multiple charge pumps, one charge pump may be a positive voltage charge pump while the other charge pump may be a negative voltage charge pump, however other embodiments are not so limited. As enough charge is accumulated in one or both of capacitors C13 and C14, a spark gap may provide energy to the primary winding of T2, and thus provide enough charge to heat up a gas in lamp 260 to provide illumination.

In some embodiments, after a startup phase of a lamp 260, the bridge circuit 400 may be configured to decrease the voltage supplied to the lamp igniter circuit 600 and may provide a substantially constant voltage to the lamp igniter circuit 600 by using flyback converter T1 and bridge circuit 400. Additionally, in some embodiments the bridge circuit 400 may be configured to provide a 50% duty cycle before and after the startup phase. In some embodiments, the control circuit may further comprise a timer circuit to control a duration the lamp driver circuit 200 is in a startup phase.

According to some embodiments, the power stage 300 may further comprise a coupling capacitor C4 connected to a winding of similar phase on either side of the flyback converter T1, wherein the coupling capacitor C4 may smooth the direct current signal output to the bridge circuit 400.

In an embodiment, the flyback converter T1 may further be connected with an inductor L3 and a diode D3 in series, wherein the inductor and diode in series reduce electromagnetic interference in the direct current signal output to the bridge circuit. In some embodiments, the control circuit 500 may further comprise an error amplifier U5 to regulate the voltage of the direct current signal provided by the power stage 300 to compensate for a change in lamp voltage by lamp 260.

Figure 7:
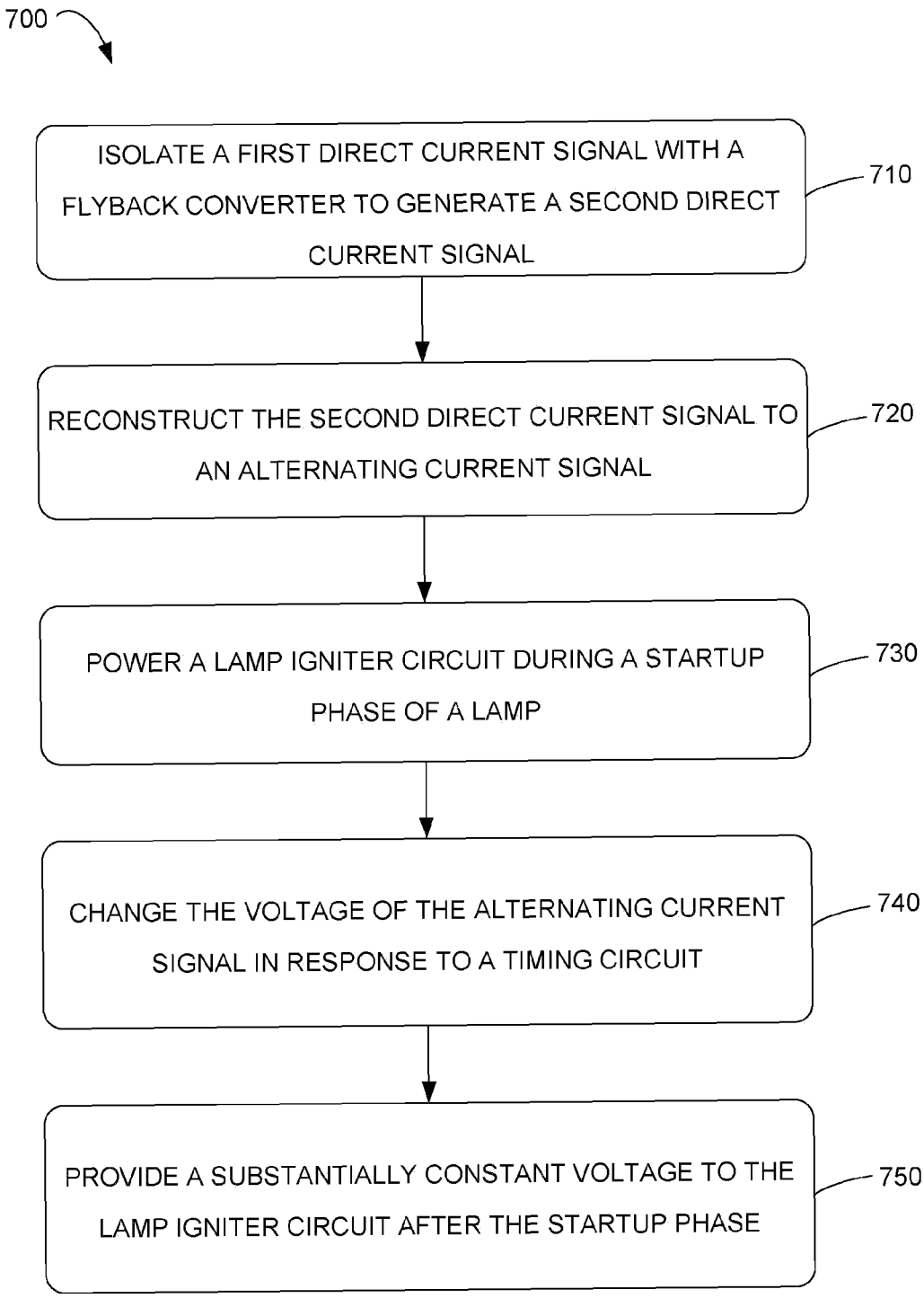
FIG. 7 shows a process flow depicting an embodiment of a method according to the principles of this disclosure.

FIG. 7 shows a process flow depicting an embodiment of a method for projection using ballast with a flyback converter according to the principles of this disclosure. First, as indicated in block 710, method 700 comprises isolating a first direct current signal with a flyback converter to generate a second direct current signal. In some embodiments, method 700 may further comprise coupling a capacitor between corresponding phase windings in the flyback converter to smooth the second direct current signal. Additionally, in some embodiments, method 700 may further comprise coupling the flyback converter with an inductor and a diode in series to reduce electromagnetic interference in the second direct current signal.

Method 700 also comprises reconstructing the second direct current signal to an alternating current signal, as indicated in block 720. In some embodiments, method 700 may further comprise increasing the frequency of the alternating current signal during a startup phase.

Next, method 700 comprises powering a lamp igniter circuit during a startup phase of a lamp, as indicated at block 730. In block 740, method 700 comprises changing the voltage of the alternating current signal in response to a timing circuit. And in block 750, method 700 further comprises providing a substantially constant voltage to the lamp igniter circuit after the startup phase.

In some embodiments and after a startup phase, the voltage supplied to a lamp igniter circuit may be regulated by an error amplifier to adjust the voltage in response to changes in a lamp. For example, as the ambient temperature varies, as a lamp overheats, etc., the voltage draw by the lamp may vary to maintain the same illumination. Further, some embodiments may further comprise providing an alternating current signal with a 50% duty cycle before and after the startup phase. Additionally, in some embodiments of the invention, the lamp driver circuit is configured to be powered by a safety extra low voltage (SELV) direct current power supply.

It will further be understood that the configurations and/or approaches described herein are exemplary in nature, and that these specific embodiments or examples are not to be considered in a limiting sense, because numerous variations are possible. The specific routines or methods described herein may represent one or more of any number of processing strategies. As such, various acts illustrated may be performed in the sequence illustrated, in other sequences, in parallel, or in some cases omitted. Likewise, the order of any of the above-described processes is not necessarily required to achieve the features and/or results of the embodiments described herein, but is provided for ease of illustration and description. The subject matter of the present disclosure includes all novel and nonobvious combinations and subcombinations of the various processes, systems and configurations, and other features, functions, acts, and/or properties disclosed herein, as well as any and all equivalents thereof.

What is claimed is:

1. A lamp driver circuit comprising;

a power stage circuit including a flyback converter to output a direct current signal to a bridge circuit, the bridge circuit to reconstruct the direct current signal to an alternating current signal;

a control circuit coupled with the power stage circuit and the bridge circuit, the control circuit to receive the direct current signal from the power stage circuit and to provide a frequency control signal to the bridge circuit; and a lamp igniter circuit comprising at least one charge pump and being coupled with the bridge circuit, wherein in response to the frequency control signal being provided to the bridge circuit, the bridge circuit is configured to increase the voltage of the alternating current signal provided to the lamp igniter circuit to power the lamp igniter circuit, wherein the bridge circuit includes 4 switches arranged in 2 alternate pairs and configured to reconstruct the direct current signal to an alternating current signal, wherein each switch has a capacitor coupled across its terminals.

2. The lamp driver circuit of claim 1, wherein lamp driver circuit is configured to be powered by a safety extra low voltage (SELV) direct current power supply.

3. The lamp driver circuit of claim 1, wherein each capacitor is configured to reduce power dissipation in a coupled switch.

4. The lamp driver circuit of claim 1, wherein the power stage further comprises a coupling capacitor connected to a winding of similar phase on either side of the flyback converter, the coupling capacitor to smooth the direct current signal output to the bridge circuit.

5. The lamp driver circuit of claim 1, the flyback converter further connected with an inductor and a diode in series, wherein the inductor and diode in series reduce electromagnetic interference in the direct current signal output to the bridge circuit.

6. The lamp driver circuit of claim 1, wherein the control circuit further comprises an error amplifier to regulate the voltage of the direct current signal provided by the power stage to compensate for a change in lamp voltage.

7. The lamp driver circuit of claim 1, wherein after a startup phase the bridge circuit is configured to decrease the voltage supplied to the lamp igniter circuit and is further configured to provide a substantially constant voltage to the lamp igniter circuit.

8. The lamp driver circuit of claim 7, wherein the bridge circuit is configured to provide a 50% duty cycle before and after the startup phase.

9. The lamp driver circuit of claim 7, wherein the control circuit further comprises a timer circuit to control a duration the lamp driver circuit is in a startup phase.

10. A method comprising:

isolating a first direct current signal with a flyback converter to generate a second direct current signal;

reconstructing the second direct current signal to an alternating current signal;

powering a lamp igniter circuit during a startup phase of a lamp;

changing the voltage of the alternating current signal in response to a timing circuit;

providing a substantially constant voltage to the lamp igniter circuit after the startup phase; and coupling a capacitor between corresponding phase windings in the flyback converter to smooth the second direct current signal.

11. The method of claim 10, further comprising coupling the flyback converter with an inductor and a diode in series to reduce electromagnetic interference in the second direct current signal.

12. The method of claim 10, further comprising increasing the frequency of the alternating current signal during a startup phase.

13. The method of claim 10, wherein after a startup phase the voltage supplied to the lamp igniter circuit is regulated by an error amplifier to adjust the voltage in response to changes in a lamp 14. The method of claim 13, further comprising providing an alternating current signal with a 50% duty cycle before and after the startup phase.

15. A lamp driver circuit comprising;

a power stage circuit including a flyback converter to output a direct current signal to a bridge circuit, the bridge circuit to reconstruct the direct current signal to an alternating current signal;

a control circuit coupled with the power stage circuit and the bridge circuit, the control circuit to receive the direct current signal from the power stage circuit and to provide a frequency control signal to the bridge circuit; and a lamp igniter circuit comprising at least one charge pump and being coupled with the bridge circuit, wherein in response to the frequency control signal being provided to the bridge circuit, the power stage circuit is configured to increase the voltage of the direct current signal output to the bridge circuit, wherein the bridge circuit increases the voltage of the alternating current signal provided to the lamp igniter circuit, to cause the lamp to generate light, wherein the bridge circuit includes 4 switches arranged in 2 alternate pairs and configured to reconstruct the direct current signal to an alternating current signal, wherein each switch has a capacitor coupled across its terminals.

16. The lamp driver circuit of claim 15, wherein the bridge circuit is configured to provide a 50% duty cycle substantially independent of the voltage of the direct current signal output to the bridge circuit.

17. The lamp driver circuit of claim 15, wherein the control circuit further comprises a timer circuit to decrease the voltage of the direct current signal output to the bridge circuit after the lamp generates light.

18. The lamp driver circuit of claim 15, wherein the power stage further comprises a coupling capacitor connected to a winding of similar phase on either side of the flyback converter, the coupling capacitor to smooth the direct current signal output to the bridge circuit.

* * * * *